United States Patent [19]

Josephson

[11] 4,388,562

[45] Jun. 14, 1983

[54] ELECTRONIC BALLAST CIRCUIT

[75] Inventor: Elliot Josephson, Los Altos, Calif.

[73] Assignee: Astec Components, Ltd., Santa Clara, Calif.

[21] Appl. No.: 204,561

[22] Filed: Nov. 6, 1980

[51] Int. Cl.[3] ..... H05B 37/00; H05B 39/00; H05B 41/14

[52] U.S. Cl. ..... 315/205; 315/DIG. 5; 315/DIG. 7; 315/178; 315/195; 315/277; 315/278

[58] Field of Search ..... 315/DIG. 5, DIG. 7, 315/276, 206, 277, 278, 282, 178, 179, 182, 205, 195

[56] References Cited

U.S. PATENT DOCUMENTS

| | | | |
|---|---|---|---|
| 3,754,160 | 8/1973 | Jensen | 331/113 A |
| 4,004,187 | 1/1977 | Walker | 315/DIG. 5 |
| 4,051,413 | 9/1977 | Abadie | 315/DIG. 7 |
| 4,060,751 | 11/1977 | Anderson | 331/113 A |
| 4,060,752 | 11/1977 | Walker | 315/DIG. 5 |
| 4,127,795 | 11/1978 | Knoll | 315/DIG. 5 |
| 4,199,710 | 4/1980 | Knoll | 315/DIG. 5 |
| 4,237,403 | 12/1980 | Davis | 315/DIG. 5 |
| 4,245,177 | 1/1981 | Schmitz | 331/113 A |
| 4,259,614 | 3/1981 | Kohler | 315/DIG. 7 |
| 4,277,728 | 7/1981 | Stevens | 315/DIG. 5 |

*Primary Examiner*—Saxfield Chatmon, Jr.

*Attorney, Agent, or Firm*—Fitch, Even, Tabin, Flannery & Welsh

[57] ABSTRACT

An electronic ballast circuit for powering a plurality of fluorescent lamps or the like from an unsmoothed DC voltage source includes a sine wave converter operatively connected to receive said DC voltage, for generating a high frequency alternating voltage of sufficient amplitude to power said lamps. The converter comprises a tank circuit and two push-pull transistors connected thereto and a current source capacitively coupled to said tank circuit for providing base drive alternately to each transistor. A lamp filament heater current cancellation circuit reduces power drain once the lamps have turned on.

13 Claims, 6 Drawing Figures

ELECTRONIC BALLAST CIRCUIT

Figure 1:
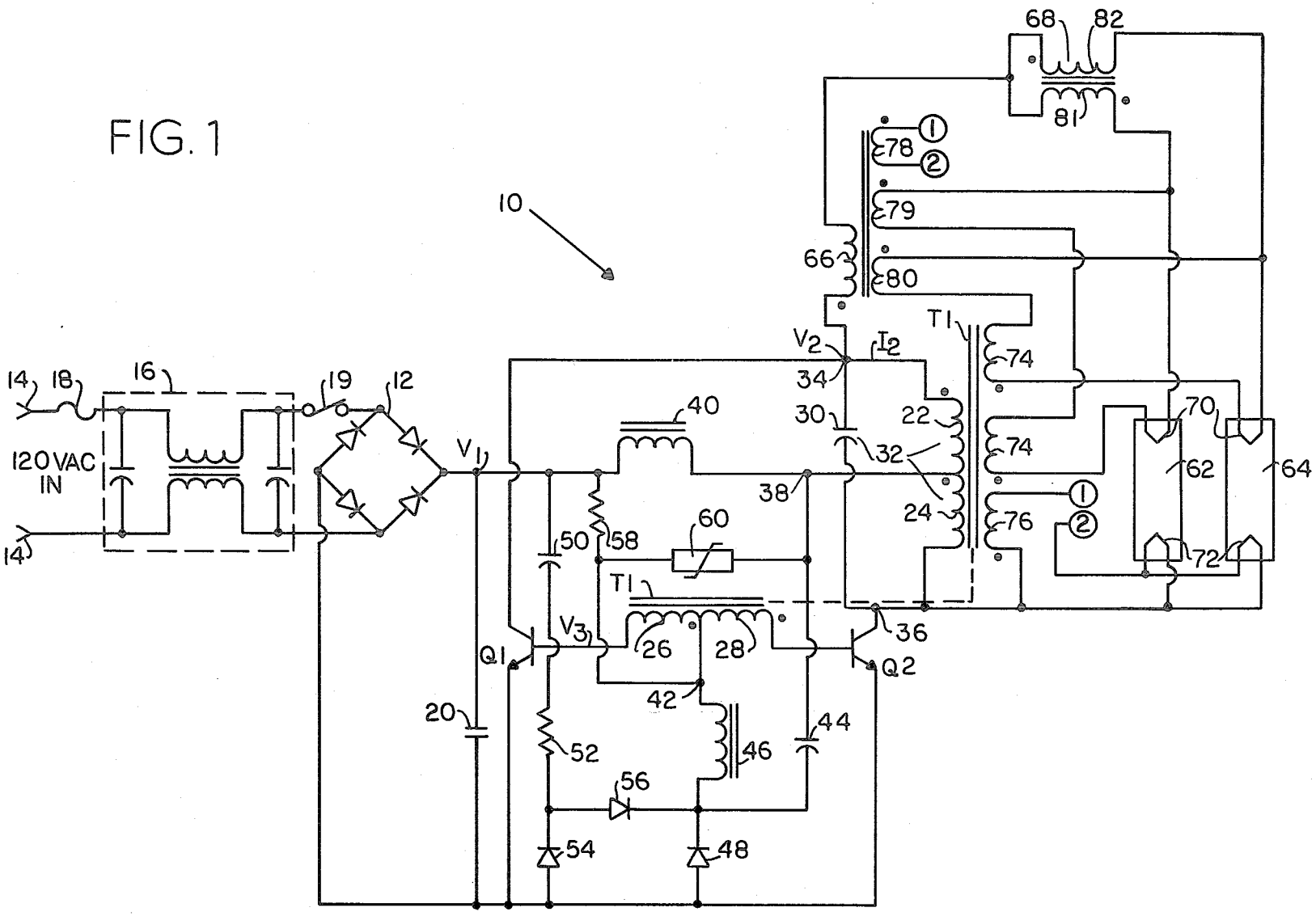

This invention relates to an electronic ballast circuit useable for powering fluorescent lamps or the like and more particularly to improvements in means for driving a sine wave converter circuit powered by an unsmoothed DC power source, and to means for cancelling lamp filament heater voltage after a lamp has gone on.

Classical, non-electronic current limiting ballasts for powering lamps from an AC power supply (e.g. 115 V/60 Hz) are of low efficiency. To improve efficiency, electronic ballast circuits are used. Such electronic ballast circuits generally have included a rectifier means including a high value electrolytic capacitor to rectify the AC voltage to produce a smoothed DC voltage, an inverter or converter means connected to receive the DC voltage and to produce therefrom a high frequency alternating output voltage of sufficient amplitude to power one or more fluorescent lamps, and current limiting means to limit the current supplied from the converter means to the lamp. In the present context, "high frequency" means a frequency of at least 20 kHz, whereby the circuit operates substantially silently since the frequency is above the audio range.

These electronic ballast circuits are subject to a number of disadvantages. First, the frequency of the converter means in such circuits is substantially dependent on the amplitude of the DC voltage with which it is supplied, whereby under certain circumstances the frequency could drop below 20 kHz. Second, these circuits have a very poor crest factor since they draw current from the AC supply in short bursts every half cycle of the input voltage, whereby the circuit (particularly if a large number of them are used) can adversely affect the input supply waveform. Third, the reliability of these circuits is not good, in particular due to the presence of the electrolytic capacitor. Fourth, it can be difficult to satisfactorily design these circuits to have a sufficiently high power factor. Fifth, where the converter means comprises a pair of push-pull transistors, the base drive to each is through a resistor, an arrangement which creates an excessive amount of heat under certain conditions. Prior art ballast circuits that have lamp filament heaters, which enable the lamps to turn on more easily, also add inefficiency since such heaters remain powered after the lamp goes on.

Certain electronic ballast circuits have been designed with the electrolytic capacitor omitted and with the circuit driven by the resultant full wave rectified signal generated from the AC source. Use of this pulsed DC voltage overcomes many of the above described disadvantages of earlier circuits, but creates other problems especially where two transistors are configured in a push-pull circuit as part of the converter means. If both transistors are off at the same time, the voltage across each of the transistors goes up until breakdown occurs, damaging the circuit.

According to the present invention there is provided an electronic ballast circuit comprising rectifier means for connection to an AC input voltage to produce a DC input voltage, converter means connected to receive said DC input voltage and to produce therefrom a high frequency alternating output voltage of sufficient amplitude to power one or more fluorescent lamps, and current limiting means to limit the current supplied, in use, from the converter means to the lamp(s), wherein the converter means is of a push-pull transistor pair type that will function over a range of DC input voltages extending from substantially zero to at least the peak amplitude of the AC input voltage to the rectifier means, wherein base drive for each transistor is derived from a constant current source fed capacitively from a high frequency sine wave, and wherein the current source output is steered by steering means to one or the other of said transistor bases.

The present invention further includes means for substantially cancelling the power drain created by lamp filament heaters after the lamp has been started and goes on.

Therefore, an object of the present invention is to overcome disadvantages of prior art ballast circuits by providing an electronic ballast circuit wherein the frequency of the converter means is substantially independent of the DC input voltage, wherein, due to the absence of the need to provide smoothing, no electrolytic capacitor is needed across the rectifier means, thereby improving reliability and also reducing cost, and wherein means are provided for protecting the push-pull transistors in the converter means from voltage breakdown.

Another object of the present invention is to improve the efficiency of power usage in a ballast circuit by providing means for substantially cancelling the filament heater power drain in each lamp after that lamp has gone on.

Still another object of the present invention is to provide a starting means for the converter means for forcing one of said push-pull transistors to go on, thereby starting the operation thereof when the circuit is first powered up, and thereafter whenever the DC input voltage drops substantially to zero.

These and other objects and advantages of the present invention will become more apparent upon reference to the accompanying drawings and following description, in which:

FIG. 1 is a circuit diagram of an electronic ballast circuit according to the present invention; and FIGS. 2A to 2E show waveforms present in the circuit of FIG. 1.

Referring now to FIG. 1, shown is an electronic ballast circuit 10 according to the present invention. The present invention is preferably powered from a source of unsmoothed or pulsed DC voltage $V_1$ obtained in a conventional manner. DC voltage $V_1$ is preferably generated from a rectifier means comprising a full wave diode bridge 12 which has coupled to it an AC input voltage supplied to a pair of input terminals 14 from an AC power source. A conventional EMI filter means 16 may be connected between terminals 14 and rectifier means 12. A fuse 18 and thermal cutout switch 19 may also be added to provide further protection for the components of the ballast circuit 10.

DC voltage $V_1$ is coupled to, and provides power for, a sine wave converter, which produces a high frequency sine wave output voltage of sufficient amplitude to power one or more fluorescent lamps or the like. The present ballast circuit 10 preferably is used to power two lamps connected in parallel to the sine wave converter.

Although the present invention is operable with a smooth or filtered DC voltage source, as described above, it is desirable to operate the present invention for efficiency of power consumption from a pulsed DC, i.e. the unfiltered AC full wave rectified voltage source. Consequently, an electrolytic capacitor is not needed on the output of the rectifier means 12, according to the present invention, to smooth out the DC voltage. A capacitor 20 may be added as shown in FIG. 1 to operate as a high frequency filter for preventing any signal generated by the sine wave converter according to the present invention from feeding back onto the AC power line. Capacitor 20 is not intended to filter the input DC voltage. Consequently, the value of this capacitor 20 need only be high enough to provide a low impedance path at the high operating frequency of the sine wave converter.

The sine wave converter includes a transformer T1, including two 70 turn windings 22 and 24 and two 1-turn windings 26 and 28. Connected in parallel with windings 22 and 24 is a capacitor 30 windings 22 and 24 and capacitor 30 constituting a tank circuit 32 tuned to resonate at a particular frequency. In the preferred embodiment, the chosen frequency of resonance should be at least 20 kHz to insure operation of the ballast circuit 10 above the audible frequency range. Associated with transformer T1 are two transistors Q1 and Q2, with the collector of Q1 connected to tank circuit 32 at terminal 34 and the collector of transistor Q2 connected to tank circuit 32 at terminal 36. The center tap of transformer T1 between windings 22 and 24, shown at 38, is connected to the DC voltage source through an inductor 40. The other center tap of transformer T1, between windings 26 and 28, is shown at 42. The other end of windings 26 and 28 are connected respectively to the bases of transistors Q1 and Q2.

As will be described in more detail hereinbelow, the bases of transistors Q1 and Q2 are driven from one of four current sources. The main current source comprises capacitor 44, inductor 46, and diode 48, with this network of components providing current during the normal operation of the ballast circuit 10, i.e., when tank circuit 32 is oscillating and the DC voltage $V_1$ is above a certain minimum voltage level. Two other current sources are provided, and function to start or restart the switching action of transistors Q1 and Q2. Capacitor 50, resistor 52 and diodes 54 and 56 operate as a current source to provide current to transistors Q1 and Q2 whenever the DC voltage $V_1$ has just begun rising from substantially zero volts. This occurs when the ballast circuit 10 first is started up and thereafter every half cycle of the input 60 Hz waveform generated by the AC voltage source. Resistor 58 and voltage dependent resistor 60 provide two alternate current sources to provide restarting of the switching of transistors Q1 and Q2 at other times when both transistors may have erroneously gone off.

Also connected across transformer T1 at terminals 34 and 36 are preferably two fluorescent lamps 62 and 64. These lamps 62, 64 are connected in parallel rather than in series to enable one of the lamps to remain on even if the other lamp has failed and become an open circuit. Connected in series between lamps 62, 64 and terminal 34 is a current limiting means comprising an inductor 66. Also connected in series between terminal 34 and lamps 62 and 64 on the lamp side of inductor 66 is a balancing transformer 68. The operation of these two elements 66 and 68 is described below. Note that these elements could also be connected in series on the other side of transformer T1, between the lamps and terminal 36.

Each lamp 62, 64 also includes a conventional filament at each end of the lamp, shown at 70 and 72. Each filament is preferably connected to filament heater means comprising a winding 74 for each of the filaments 70 and a winding 76 for both filaments 72. These windings provide a heater current for filaments 70 and 72 to facilitate the rapid and non-destructive turning on of lamps 62 and 64. Heating of the filaments prevents dark spots in the lamps created by metal ions stripped from the filaments without filament heating which are deposited around the inside of the lamp, and also prevents the need for a higher voltage to turn on the lamps in the same amount of time.

Once the fluorescent lamps 62, 64 have gone on, the heater current generated by the coil 74, 76 is not needed, and constitutes an unnecessary power drain in the ballast circuit 10. To substantially cancel out this power drain, filament cancellation means are provided to substantially limit this power loss. In the present invention, the filament cancellation means comprises a plurality of coils, identified as coils 78, 79 and 80, which are inductively coupled to inductor 66. Each coil 78–80 are associated with a corresponding one of said heater coils 74, 76 as shown in FIG. 1. Voltage is generated across these windings 78–80 only after the lamp 62 and 64 have gone on, when the high frequency lamp driving current creates a voltage across inductor 66. As can be seen from the dot arrangement of windings 78–80 compared with windings 74 and 76, the voltage generated by windings 78–80 are 180° out of phase with the voltage generated by coils 74, 76, thereby substantially negating the voltage of the heater current. Consequently, a reduction of over 75% of the power drain from the heater current is obtained, with a corresponding reduction of a number of watts, perhaps 10–15%, of the total power consumption of the ballast circuit 10.

The converter means of the electronic ballast circuit 10 according to the present invention operates in the following manner. During normal operation, with the circuit already started and tank circuit 32 oscillating, the core of transformer T1 is common to windings 22 and 24 and windings 26 and 28. Thus, the sine wave oscillations on windings 22 and 24 and tank circuit 32 also appear as a sine wave across windings 26 and 28. As mentioned above, these windings 26 and 28 are tied to the bases of Q1 and Q2. Thus, for example, if transistor Q1 is on, terminal 34, which is tied to the collector of transistor Q1, is essentially at ground. This produces a voltage drop on the 70 turn winding 22, making the dot end of winding 22 negative with respect to center tap 38. Since the dot on winding 26 is at the center tap 42, this point is negative with respect to the other side of winding 26 at the base of transistor Q1. Thus, a positive voltage is generated at the base of transistor Q1, and is identified as $V_3$ in FIG. 1. With the base of transistor Q1 positive, the current through inductor 46 is steered through winding 26 into the base of transistor Q1, maintaining transistor Q1 on. At the same time, the base of transistor Q2 is held negative because of the same voltage drop occurring across winding 28. When the tank circuit is in its other half cycle, terminal 36 begins to go positive with respect to terminal 34, causing the voltage drop across the steering coils 26 to 28 to steer current to the base of transistor Q2 and away from the base of transistor Q1, turning transistor Q2 on and turning off transistor Q1.

The DC voltage $V_1$ powers the tank circuit 32 through inductor 40. Inductor 40 acts to isolate the sine wave oscillations of tank circuit 32 from the 60 Hz pulsating DC voltage $V_1$. Inductor 40 also is a current limiter to protect the transistors Q1 and Q2 from drawing maximum current. This is because without this inductor 40 the voltage at transformer T1 center tap 38 would be limited to a maximum of approximately 100 volts, the voltage of the input DC voltage $V_1$. This would cause tank circuit 32 to essentially operate as a square wave inverter rather than a sine wave inverter. In addition, without current limiting, transformer T1 would stop being a transformer and the impedance of those windings 22 and 24 would disappear. The input voltage $V_1$ would as a result be directly connected across the collector of these transistors. With too much current, the transistor would probably be rapidly destroyed.

Inductor 46 operates to provide a continuing current through windings 26 and 28 into the bases of the transistors Q1 and Q2 during the crossover point in the operation of tank circuit 32, i.e. wherein the voltage at the tank circuit terminal crosses zero. Without inductor 46, the current would die out, causing both transistors to turn off, with the result that the voltage at the collectors of the transistors would rise very rapidly and perhaps cause their destruction. In other words, inductor 46 insures that at the crossover point when transformer T1 is switching the polarity of its windings, that there is a small amount of current flowing through windings 26 and 28 into the bases of transistors Q1 and Q2. This enables the one transistor that has been already on to remain on for a short, additional length of time, and to enable the transistor about to be on to turn on sooner. At this point, both transistors will be conducting in a so-called variable dissipation mode. The normal mode of operation, when one transistor is on and the other transistor is off, is that the on transistor is in saturation, thereby acting substantially as a closed switch in that state, and the off transistor is essentially an open switch.

Inductor 46 also assists in turning on one of the transistors Q1 or Q2 when the DC voltage $V_1$ goes to zero 120 times a second. The inductor continues to output current for a short time after $V_1$ goes to zero, while ringing of the tank circuit 32, which will also generally occur for a short time after power is removed, helps steer this current to one or the other transistors Q1 or Q2 until the DC voltage $V_1$ begins again to go up.

As mentioned above, during the normal switching operation of transistors Q1 and Q2, the base current is derived through capacitor 44 from the center point 38 of transformer T1. This capacitor is a current source since the center point of transformer T1 is going from a ground potential up to a high voltage level of an amount depending on the voltage level of the DC voltage $V_1$, e.g. 250 volts, which varies at tank circuit 32 oscillation rate of over 20 kHz. Consequently, for a small capacitor, you get a fairly large amount of current passing through the capacitor, on the order of 300 milliamps peak, and the current is a square wave. Diode 48 acts as a halfway rectifier enabling capacitor 44 to conduct current only in the forward direction into inductor 46. In summary, capacitor 44 acts as the source for the primary running current for the bases of transistors Q1 and Q2 during their normal switching operations.

Capacitor 50, resistor 52 and diodes 54 and 56 provide starting current for the bases of transistors Q1 and Q2 via inductor 46 at those times when the DC voltage $V_1$ is starting at zero volts. Since capacitor 50 is tied to the DC voltage $V_1$, it generates a positive going current limited by resistor 52 which then flows through diode 56 and into inductor 46. Diode 56 prevents current generated through capacitor 44 from flowing in the opposite direction. Diode 54 allows current to flow only in the forward direction through capacitor 50.

It should be realized that prior to start-up, both transistors Q1 and Q2 are off. The current generated by capacitor 50 and resistor 52 is designed to be sufficient to supply enough current to drive the bases of both transistors, since at start-up, transformer T1 is not oscillating, so that no steering of the current is provided by windings 26 or 28. Since one transistor in the pair will always have a slightly higher gain than the other, that transistor will turn on first. This causes a voltage drop in the corresponding 70 turn winding 22 or 24, which then couples this voltage back to the steering winding 26 and 28. This voltage drop thereby causes steering of the current into the transistor that is on, reinforcing the on state of that transistor. The current to the base of the other transistor is correspondingly reduced. Resistor 58 functions to provide a current to the bases of transistors Q1 and Q2 if for some reason the sine wave oscillator stalls at some point other than at the start of a half cycle, i.e. at some point when the input DC voltage $V_1$ is not at zero volts. Normally, the resistance of resistor 58 is high enough to that no current flows through this resistor during normal start-up operation. This current path is needed because, at these higher voltage ranges, insufficient current may be available from the starting means comprising capacitor 50 and resistor 52 to turn on transistors Q1 or Q2 without such assistance.

Another protective device for transistors Q1 and Q2 is the voltage dependent resistor 60. Resistor 60 provides another path for current to flow into the bases of transistors Q1 and Q2. Resistor 60 is designed to operate when current is flowing in inductor 40 and neither transistor Q1 nor Q2 is on. If resistor 60 were not there, this current would cause the voltage at the center point 38 of the transformer to rapidly increase to destructive levels. Consequently, resistor 60 operates to create a current path to the base of transistors Q1 and Q2 whenever center point 38 of transformer T1 goes above a certain voltage, e.g. 300 volts. At this point, the voltage dependent resistor 60 begins to conduct, dumps current into the base windings and forces one or the other of transistors Q1 or Q2 to turn on in the same manner as the starting circuit forces one or the other of the transistors to turn on.

Inductor 66 comprises current limiting means for limiting the current that is enabled to flow across the fluorescent lamps 62 and 64. The inductance of inductor 66 is chosen such that at the predetermined running frequency of the sine wave converter means, inductor 66 will limit the current to the specific level at which lamps 62 and 64 work at their rated output.

The current limiting function of inductor 66 operates to allow full voltage to appear across lamps 62 and 64 when both lamps are unlit. This voltage is of the order of greater than 300 volts. Once the lamps are lit, however, they only require and desire between 70 and about 85 volts. The balance of this voltage is then carried across inductor 66. It is the variation of this voltage drop across inductor 66 that provides the voltage on filament cancellation coils 78–80 for cancelling of the voltage of the filament heater current.

Transformer 68 acts as a balancing transformer. Transformer 68 includes two windings, winding 81 and winding 82, connected respectively to lamps 62 and 64. In operation, windings 81 and 82 are phased such that if one lamp turns on before the other lamp goes on, the lamp that is on will cause a voltage drop in the associated winding such that the opposite winding will produce a higher voltage across the still unlit lamp. This helps this other lamp to go on and light up more quickly than if transformer 68 was not in the circuit. Subsequently, with both lamps operating, transformer 68 acts to balance the current flow into each of the lamps, keeping them at equal brightness. This operation occurs, since if one lamp starts to carry more current, it will force a higher voltage on the other lamp, which will then draw its corresponding share of the current.

The filament heater coils on transformer T1, and the operation of the filament cancellations means, comprising coils 78–80 on inductor 66, were previously described.

Figure 2A:
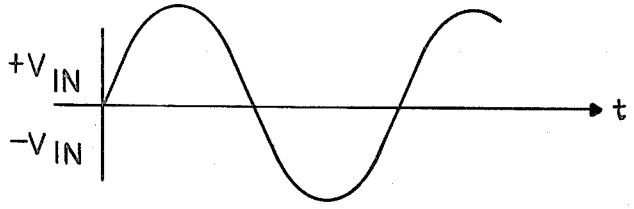
Figure 2B:
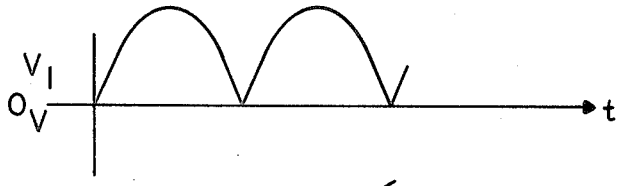

FIGS. 2A–E illustrate certain of the waveforms present in the electronic ballast circuit 10 according to the present invention. FIG. 2A and 2B illustrate merely the operation of the rectifier means 12 on the AC input voltage shown in 2A to create a full wave rectified AC voltage, the pulsed or unsmoothed DC voltage $V_1$ shown in FIG. 2B. As is seen in FIG. 2B, pointed out above, at every half cycle of the 60 Hz AC wave, the DC voltage $V_1$ drops substantially to zero volts. At each of these points, the starting circuit comprising resistor 52 and capacitor 50 acts to insure that the sin wave converter means restarts, and continues to generate switching of transistors Q1 and Q2.

Figure 2C:
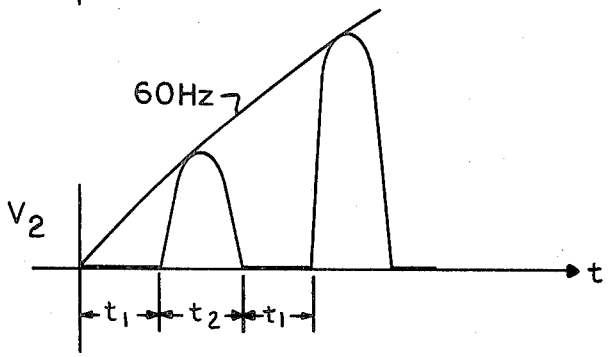
Figure 2D:
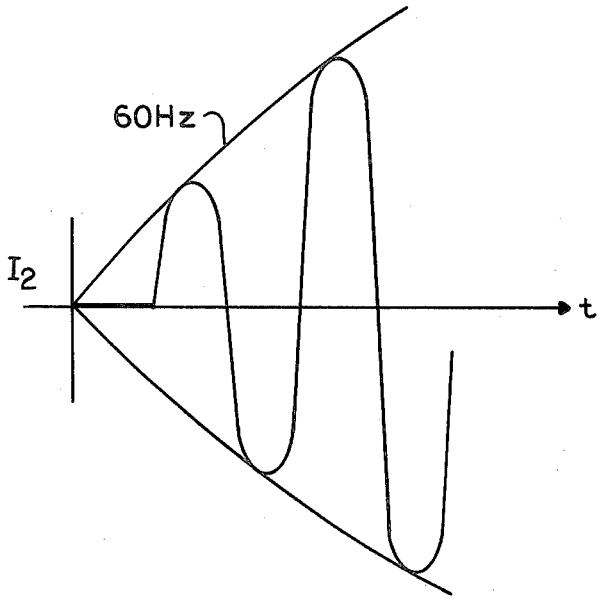
Figure 2E:
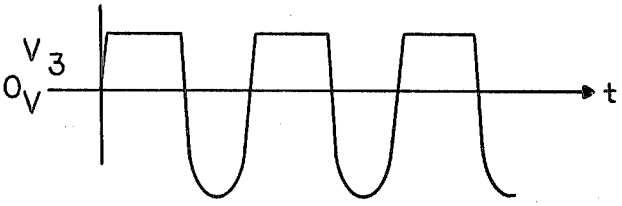

FIGS. 2C, 2D and 2E illustrate the operation of the sine wave converter at only a section of time during a given 60 Hz period. Specifically, FIG. 2C illustrates the variation in voltage $V_2$ at terminal 34 of tank circuit 32. As is seen, the voltage is a half wave rectified signal whose amplitude rises up to the then current amplitude of the 60 Hz envelope. The operation of transistor Q1 is such that when transistor Q1 is on, at time period t1, the voltage at terminal 34 is essentially at ground, and when transistor Q1 is off, at time period t2, the voltage at terminal 34 is allowed to reflect the sinusoidal waveform of tank circuit 32. The frequency of this halfwave rectified waveform is the frequency of the tank circuit, which as mentioned above, is on the order of something greater than 20 kHz. FIG. 2D illustrates the current $I_2$ of the tank circuit, and shows that this current waveform is sinusoidal and has an amplitude varying as a function of the 60 Hz envelope of the input voltage $V_1$. Finally, FIG. 2E illustrates the voltage $V_3$ at the base of transistor Q1, and shows the turning on and turning off of transistor Q1 also at the greater than 20 kHz rate.

It is of course understood that although the preferred embodiment of the present invention has been illustrated and described, various modifications, alternatives and equivalents thereof will become apparent to those skilled in the art and, accordingly, the scope of the present invention should be defined only by the appended claims and equivalents thereof.

I claim:

1. A sine wave converter power supply comprising:

rectifier means for converting an AC input voltage to an unsmoothed DC voltage;

converter means operatively connected to receive said unsmoothed DC voltage and to function over the range of DC voltages produced by said rectifier means extending from substantially zero volts to at least the peak amplitude of the AC input voltage to said rectifier means, said means including a tank circuit including a capacitor connected in parallel with an inductor, for producing from said unsmoothed DC voltage a high frequency alternating output voltage of sufficient amplitude to power one or more fluorescent lamps or the like, said means further including two transistors, each including a base, emitter and collector, said transistors connected such that one transistor is normally off while the other transistor is normally on, and means for alternately turning on each of said transistors, said means for turning on comprising current source means capacitively fed from said tank circuit for generating a base current of sufficient amplitude to turn on one of said transistors, and steering means for coupling said base current alternately to the base of each said transistor;

means for preventing breakdown across either transistor; and current limiting means to limit the current supplied by said converter means to each said lamp when said lamp is on.

2. The power supply of claim 1 further comprising:

starting means for forcing one of said transistors to turn on whenever said DC voltage is increasing from substantially zero volts, said means including a capacitor, a resistor and a diode connected in series and operatively connected to receive said DC voltage, and means for coupling the current generated by said series connection of said capacitor, resistor and diode to the bases of both said transistors, such that as said DC voltage exceeds a certain level, said generated current causes one or the other of said transistors to turn on.

3. The power supply of claim 1 further comprising voltage boost means connected between said current limiting means and said lamps for boosting the voltage to any lamp not yet turned on once any other lamp has turned on.

4. The power supply of claim 3 wherein said voltage boost means comprises a transformer having a plurality of windings, each winding being connected in series between said current limiting means and a respective one of said fluorescent lamps, for generating a voltage drop across said transformer when one of said lamps has gone on, such that the voltage drop across said other lamp or lamps is increased.

5. The power supply of claim 1 wherein said means for preventing breakdown across either transistor comprises means for detecting when the voltage drop across either said transistor exceeds a predetermined level, and means for generating a current in response to the occurence of said excessive voltage and for coupling said current to the bases of both said transistors, said generated current causing one or the other of said transistors to turn on.

6. The power supply of claim 1 wherein said current limiting means comprises an inductor connected in series between said converter means and said one or more fluorescent lamps or the like.

7. The power supply of claim 1 further comprising means for coupling a heater current to the filament element of each said lamp; and means for substantially cancelling said heating current in each lamp after said lamp has turned on, including means for generating a voltage signal of a phase substantially 180° out of phase with the voltage of said heater current for each said lamp, said means operative only after that lamp has gone on, and for coupling said out of phase voltage signal to the filament elements of such lamp.

8. A sine wave converter power supply for powering one or more fluorescent lamps or the like comprising:

rectifier means for converting an AC input voltage to an unsmoothed DC voltage;

converter means operatively connected to received said unsmoothed DC voltage and to function over the range of DC voltages produced by said rectifier means extending from substantially zero volts to at least the peak amplitude of the AC input voltage to said rectifier means, including a high frequency tank circuit comprising a capacitor in parallel with inductor windings, for producing from said unsmoothed DC voltage a high frequency alternating output voltage of sufficient amplitude to power said one or more fluorescent lamps or the like, said means including two transistors, each including a base emitter and collector, said transistors connected such that one transistor is normally off while the other transistor is on;

means for preventing breakdown across either transistor;

current limiting means comprising a current limiting inductor connected in series between said tank circuit and said lamps;

means for coupling a heater current to the filament element of each said lamp, comprising heater windings inductively coupled to said tank circuit inductor windings, and means for coupling the current generated by said heater windings when said tank circuit is oscillating to said lamp filaments; and means for substantially cancelling said heating current in each lamp after said lamp has turned on, including means for generating a voltage signal of a phase substantially 180° out of phase with the voltage of said heater current for each said lamp, said means comprising voltage cancellation windings inductively coupled to said current limiting inductor, each said cancellation winding connected in series with each said heater winding, such that a cancellation voltage is generated by each said cancellation winding, only after at least one of said lamps has gone on.

9. A sine wave converter power supply operable from an unsmoothed DC voltage source, for powering one or more fluorescent lamps or the like, comprising:

a tank circuit, including a capacitor and first and second series connected windings connected in parallel with said capacitor, for producing a high frequency sine wave output voltage of sufficient amplitude to power said lamp or lamps;

means connected between said source of DC voltage and said tank circuit for limiting current supplied to said tank circuit from said DC voltage source;

first and second transistors each including a base emitter and collector, said transistors connected such that one transistor is normally off while the other transistor is on;

means for alternately turning on each said transistor comprising current source means capacitively fed from said tank circuit for generating a base current of sufficient amplitude to turn on one of said transistors; and steering means for coupling said base current alternately to the base of each said transistor, said steering means comprising third and fourth inductive windings connected in series, the center point between said third and fourth windings having said base current coupled thereto, the other end of said third winding being coupled to the base of said first transistor, the other end of said fourth winding being coupled to the base of said second transistor, said third and fourth windings being inductively coupled to said first and second winding such that the voltage across said first and second windings is caused to appear across said third and fourth windings.

10. The power supply of claim 9 wherein said current source means further comprises current storage means for maintaining current to the center point between said third and fourth windings for a length of time after said base current diminishes to zero.

11. The power supply of claim 9 further comprising:

starting means for forcing one of said transistors to turn on whenever DC voltage is increased from substantially zero volts, said means including a capacitor, a resistor and a diode connected in series and operatively connected to receive said DC voltage, and means for coupling the current generated by said series connection of said capacitor, resistor and diode to the bases of said first and second transistors.

12. The power supply of claim 9 further comprising means for preventing breakdown across either transistor, said means comprising means for detecting an overvoltage at the center point between said first and second windings, means for generating a current in response thereto, and means for coupling said current to the bases of said first and second transistors.

13. In a lamp ballast circuit for powering at least one fluorescent lamp or the like and including means for coupling a heating current to the filament elements of each said lamp, the improvement comprising a filament cancellation circuit for substantially cancelling said heating current in each lamp after said lamp has turned on, said circuit comprising:

means for generating a voltage signal of a phase substantially 180° out of phase with the voltage of said heater current for each said lamp, said means operative only after that lamp has gone on, and four coupling said out-of-phase voltage signal to said filament element.

* * * * *